US010374299B1

(12) United States Patent
Marshall

(10) Patent No.: US 10,374,299 B1
(45) Date of Patent: Aug. 6, 2019

(54) METHOD FOR MAKING A RADIATOR STRUCTURE FOR A HELICAL ANTENNA

(71) Applicant: FIRST RF Corporation, Boulder, CO (US)

(72) Inventor: Robert J. Marshall, Longmont, CO (US)

(73) Assignee: FIRST RF Corporation, Boulder, CO (US)

( * ) Notice: Subject to any disclaimer, the term of this patent is extended or adjusted under 35 U.S.C. 154(b) by 507 days.

(21) Appl. No.: 14/615,879

(22) Filed: Feb. 6, 2015

(51) Int. Cl.
*H01Q 1/36* (2006.01)
*H01Q 11/08* (2006.01)

(52) U.S. Cl.
CPC ..... *H01Q 1/362* (2013.01); *H01Q 11/083* (2013.01); *Y10T 29/49016* (2015.01)

(58) Field of Classification Search
CPC ..... H01Q 11/083; H01Q 1/362; H01Q 1/281; Y10T 29/49016
USPC ..... 343/895
See application file for complete search history.

(56) References Cited

U.S. PATENT DOCUMENTS 3,481,249 A * 12/1969 Holloway ..... B23C 3/32 409/67
4,945,363 A 7/1990 Hoffman
5,329,287 A 7/1994 Strickland
5,604,972 A 2/1997 McCarrick
5,793,039 A * 8/1998 Oishi ..... H01J 49/067 250/288
5,914,697 A 6/1999 Seki
6,181,296 B1 1/2001 Kulisan et al.
6,608,604 B1 8/2003 Sharaiha et al.
7,050,019 B1 5/2006 Jacomb-Hood et al.
7,286,099 B1 10/2007 Lier et al.
7,944,404 B2 5/2011 Yun et al.
2013/0006345 A1* 1/2013 Mitelberg ..... A61B 17/12022 623/1.11

FOREIGN PATENT DOCUMENTS

DE 4100842 C1 * 5/1992 ..... B21D 53/886

OTHER PUBLICATIONS

Lin et al., High Gain Axial-Mode Helical Antenna with Circular Metal Disk, Progress in Electromagnetics Research C, 2011, pp. 15-25, vol. 23.

* cited by examiner

*Primary Examiner* — Livius R. Cazan
(74) *Attorney, Agent, or Firm* — Lathrop Gage LLP

(57) ABSTRACT

An embodiment of the invention is directed to a method for manufacturing a radiator structure for a conical helical antenna that includes: (a) processing a piece of metal so as to produce a first metal structure with conical exterior and interior surfaces, and (b) processing the first metal structure to remove material between the conical exterior and interior surfaces to yield a radiator structure with a conical helical shaped conductor that can be combined with a ground plane to produce a conical helical antenna. In one embodiment, the radiator structure includes a matching structure and a cap with the conical helical conductor, matching structure, and cap being a single piece of metal.

25 Claims, 11 Drawing Sheets

Figure 6, DETAIL A

Figure 15, DETAIL B

METHOD FOR MAKING A RADIATOR STRUCTURE FOR A HELICAL ANTENNA

FIELD OF THE INVENTION

The invention relates to a method for manufacturing a radiator structure suitable for use in a helical antenna.

BACKGROUND OF THE INVENTION

Generally, a helical antenna includes a ground plane, a radiator structure with a helically shaped conductor, and a mounting structure that establishes and maintains a desired orientation between the radiator structure and the ground plane. There are two types of radiator structures prevalent in helical antennas. The first type of radiator structure comprises a self-supporting helically-shaped conductor that is made of a relatively stiff metal and, as such, is capable of holding its helical shape when subjected to no more than a predetermined force (e.g., gravity). The second type of radiator structure comprises a helical shaped conductor and a dielectric structure that supports the conductor in the helical shape when subjected to no more than a predetermined force.

The method of manufacturing the first type of radiator structure typically involves providing a form with an exterior surface that defines the general shape (e.g., conical or cylindrical) of the helix conductor and a path marked on or associated with the exterior surface that defines the helical path of the conductor on the exterior of the form. For example, the form may have a cylindrical exterior surface with a helical groove established in the cylindrical exterior surface. A relatively stiff wire is wound around the form in accordance with the defined helical path associated with the form. For instance, if the form bears a helical groove, the wire is wound around the form such that the wire is established in the helical groove. After the wire has been wound around the form, the wire and the form are separated from one another. In the case of a cylinder with a helical groove, the cylinder and the helically shaped wire may be "unscrewed" from one another. In any event, the helically shaped wire is a radiator structure suitable for integration into a helical antenna. This approach to manufacturing the first type of radiator structure commonly requires significant effort in designing the form and the process for separating the form from the helically shaped wire to address, for example, issues related to elastic recovery or springback, i.e., the tendency of the wire to want to deform to some extent towards its original shape.

Several methods have been devised for manufacturing the second type of radiator structure. One method for manufacturing this type of radiator structure involves the creation of a dielectric frame that defines the overall shape of radiator structure (e.g., cylindrical or conical). Such a dielectric frame can take many forms. Among the various types of dielectric frames are: (a) mast and spar frames that include a main mast from which spars extend that engage the conductor at discrete locations and support the wire in the desired helical shape, (b) crossed and notched templates with the notches situated to engage the wire and support the wire in the desired helical shape, and (c) forms with exterior surfaces that have the desired overall shape for the conductor and, typically, a structure that defines the helical path of the conductor about the exterior surface (e.g., a cylinder with helical groove established in the exterior surface). A conductor is engaged to the frame so as to have the desired helical shape. The dielectric frame and the helically shape conductor constitute a radiator structure.

A second approach for manufacturing the second type of helical antenna element is to establish one or more conductive strips on a flexible and planar dielectric substrate. Typically, the conductive strips are established on the substrate by a photolithographic process. Subsequently, separate portions of the edge of the substrate are brought together so as to place the substrate into the desired shape (e.g., a cylinder or right circular cone). The separate portions of the edge of the substrate typically butt up against one another or overlap with one another to form a seam and are fixed in place. In many cases, the conductive strips are used to form one or more helices that are each comprised of multiple turns. For such helical antenna elements, the ends of each of the strips that are intermediate to the terminal ends of a helix must be electrically connected to one another at a point adjacent to the seam.

A third approach for manufacturing the second type of radiator structure involves providing a dielectric frame with an exterior surface. A portion of the exterior surface defines the desired helical shape of one or more electrical conductors. For example, a portion of the exterior surface may define a groove with the desired helical shape. The exterior surface of the dielectric frame is plated with an electrically conductive material and then processed so as to remove the plating that is not associated with the desired helical shape.

Yet another approach to manufacturing the second type of radiator structure includes providing a form with an exterior surface that has the overall desired shape for the helical antenna element (e.g., a cylinder), winding a polystyrene sheathed wire around the form so that the wire follows the desired helical path, applying heat to the polystyrene sheathed wire to thermo-fix the polystyrene sheathed wire in the desired helical shape, and then separating the form and the thermo-fixed polystyrene wire from one another.

SUMMARY OF THE INVENTION

A method for manufacturing a radiator structure for a helical antenna is provided. The method is applicable to the manufacture of a radiator structure in which the helically shaped conductor is modeled on a right circular cone, oblique circular cone, right elliptical cone, oblique elliptical cone, or a cylinder. Additionally, the helical shape can have a substantially constant pitch angle or a varying pitch angle.

In one embodiment, the method includes providing a piece of metal stock and processing the metal stock so as to have an frusto-conical exterior side surface and a frusto-conical interior side surface that together define a frusto-conical wall that encloses a space. At this point, the frusto-conical wall can be conceptualized as being divided into a radiator portion (i.e., the portion of the wall that embodies the radiator structure) and a non-radiator portion (i.e., the portion of the side wall that is removed or separated from the radiator portion). After establishment of the frusto-conical exterior and interior side surfaces, metal located between the exterior and interior surfaces and associated with the non-radiator portion of the side wall is removed to produce a conical helix. To facilitate the use of a milling machine to create the conical helix and reduce the probability of the milling machine damaging the helix, the removal of the metal is done in graduated manner. In a particular embodiment, the graduated removal of metal is done in three steps. In the first step, metal located between the frusto-conical interior and exterior side surfaces and associated with a non-radiator portion of the frusto-conical side wall is removed so as to partly define a portion (depth-wise) of the each lateral edge of the conical helix. In one embodiment, the portion of each of the lateral edges extends part of the way from the frusto-conical exterior surface to the frusto-conical interior surface. In a particular embodiment, the portions of the two lateral edges are established by removing material so as to establish two helical grooves in the side wall, one groove defining one of the partial lateral edges and the other groove defining the other of the partial lateral edges. Second, metal associated with the non-radiator portion is removed as to define a series of intermittent helical voids, i.e., one helical void separated from another helical void by a helical strut. At this point, substantial portions of the edges that define the helical voids also define substantial portions of the two lateral edges of the conical helix that results from the method. In the third step, each of the struts is removed to establish a larger helical void and, in so doing, establish the conical helix. In a particular embodiment, the first and second steps are accomplished with a milling machine or machines and the third step is accomplished with a hand tool. The resulting radiator structure is substantially self-supporting and, as such, avoids the need for the type of dielectric substrate used in the second type of radiator structure associated with helical antennas described hereinabove. Additionally, the resulting radiator structure avoids the need to take into account factors such as springback in the design of the manufacturing method. It should also be appreciated that the method is applicable to a conical helical conductor modeled on a right circular cone, an oblique circular cone, a right elliptical cone, and an oblique elliptical cone. Further, although the method has been described with respect to a conical helical conductor modeled on a cone, the method is also readily adapted to a conical helical conductor modeled on a cylinder. Further, the pitch angle of the helical conductor can be substantially constant or, if needed, varied to accommodate particular applications. The method is also capable of being adapted to produce a radiator structure with multiple helical conductors each modeled on the same surface, i.e., multifilar helical conductors.

In a particular embodiment, the processing of the metal stock also produces an interior surface that defines a frusto-conical interior top surface of a frustum of a cone that engages the frusto-conical interior side surface. Extending from the frusto-conical interior top surface is a stub that facilitates machining of the metal that results in the radiator structure by providing a surface that can be gripped by a collet or similar structure associated with a milling machine. A substantial portion of this stub is removed to define a frusto-conical exterior top surface. The frusto-conical interior and exterior top surfaces, in turn, define a cap. The cap prevents a reflection of a signal being processed by the antenna that would adversely affect the polarization of the antenna. It should be appreciated that the cap and conical helical conductor are a single piece of metal. As such, there is no need for a connecting structure between the cap and the conical helical conductor that could be a potential source of an undesirable passive intermode. The cap can be realized with radiator structure that has a helically shaped conductor that is modeled on a right circular cone, an oblique circular cone, a right elliptical cone, an oblique elliptical cone, or a cylinder.

In another embodiment, the processing of the metal stock also produces matching structure that is associated with the end of the helically shaped conductor that is subsequently located adjacent to the ground plane in an assembled helical antenna. The matching structure facilitates a desired or acceptable voltage standing wave ratio (VSWR) for the antenna. The matching structure and the helically shaped conductor are a single piece of metal. As such, the need for a connecting structure between the matching structure and the helically shape conductor that could be a source of an undesirable passive intermode is avoided. The matching structure can be realized with radiator structure that has a helically shaped conductor that is modeled on a right circular cone, an oblique circular cone, a right elliptical cone, an oblique elliptical cone, or a cylinder.

DETAILED DESCRIPTION

The invention is directed to a method of manufacturing a radiator structure that includes a helically shaped conductor which is suitable for use with a helical antenna. The resulting radiator structure is self-supporting and substantially avoids the need to consider springback in the design of the manufacturing method. This method of manufacturing is capable of being employed to manufacture radiator structures with helically shaped conductors suitable for use in an array of tilted conical helical antennas as described in copending U.S. patent application Ser. No. 14/572,734, which is incorporate herein by reference and in its entirety.

Figure 1:
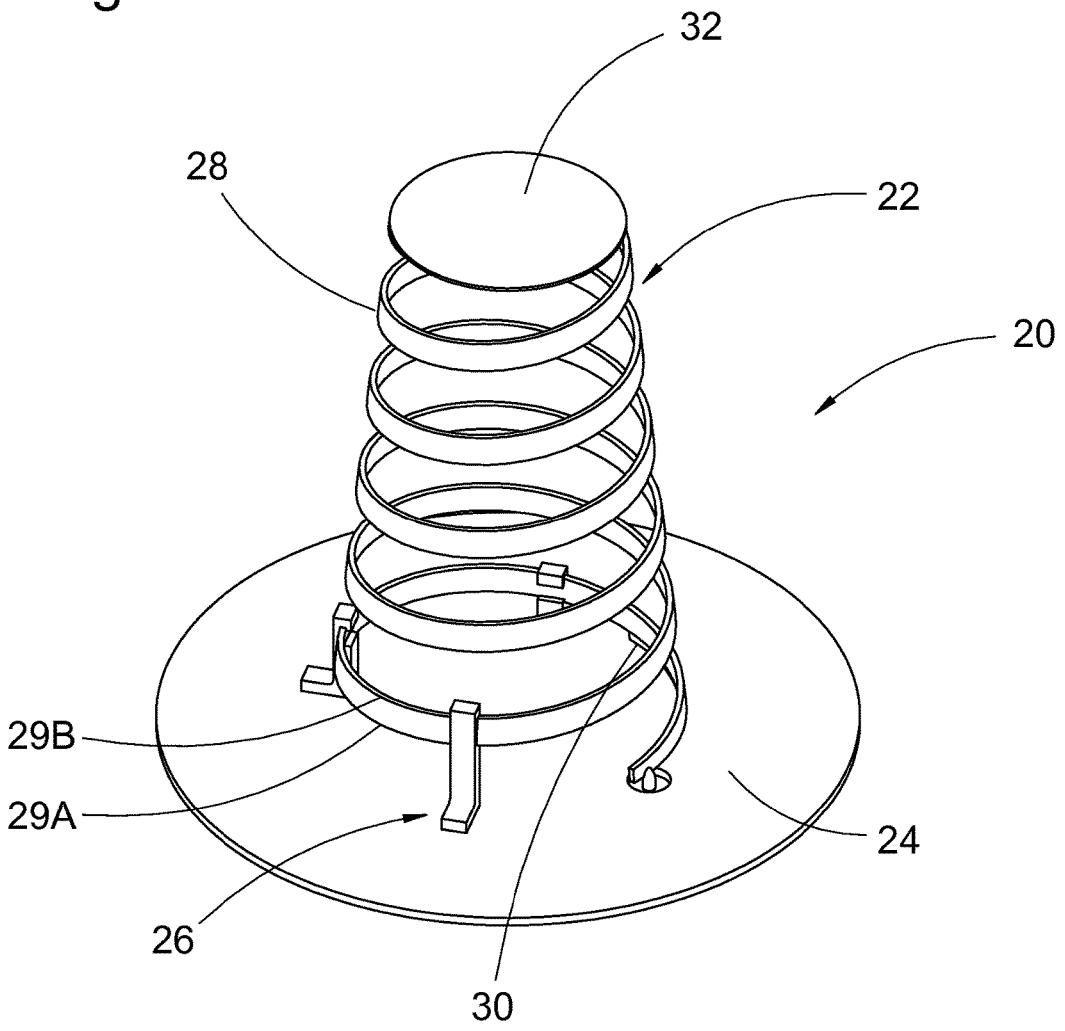
FIG. 1 illustrates an embodiment of a helical antenna that includes a conical helical conductor modeled on a right circular cone, a ground plane, and a mounting structure.

With reference to FIG. 1, an exemplary helical antenna 20 (hereinafter "antenna 20") is described. Generally, the antenna 20 comprises a radiator structure 22, a ground plane 24, and a mounting structure 26 that supports the radiator structure 22 in a desired position relative to the ground plane 24. The radiator structure 22 comprises a helically shaped conductor 28, a matching structure 30 associated one end of the conductor 28, and a cap 32 associated with the other end of the conductor 28. The helically shaped conductor 28 is the portion of the radiator structure 22 that is primarily responsible for the transmission and/or reception of electromagnetic signals by the antenna 20. The matching structure 30 provides the antenna 20 with a desired or acceptable VSWR. The cap 32 prevents the reflection of a signal being processed by the antenna 20 from adversely affecting the polarization of the antenna.

Figure 2:
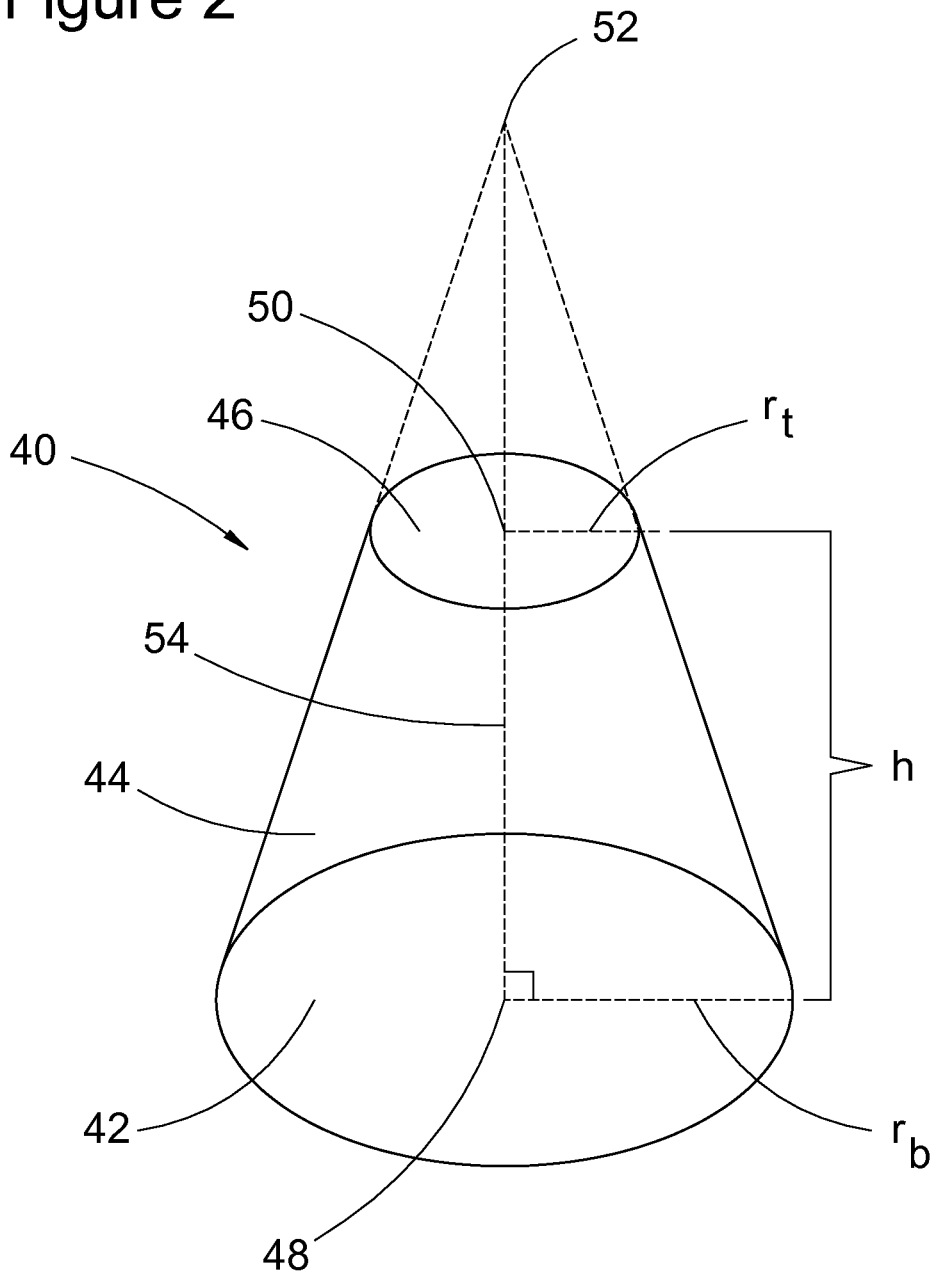
FIG. 2 illustrates a right circular cone and a frustum of a right circular cone.

The helically shaped conductor 28 is modeled on a frustum of a right circular cone. With reference to FIG. 2, a frustum of a right circular cone 40 is illustrated. The frustum of a right circular cone 40 is defined by a planar base surface 42, a lateral or side surface 44, and a planar top surface 46 that is parallel to the planar base surface 42. The perimeter of the planar base surface 42 is an ellipse and, in this example, a circle of radius $r_b$ with a base center 48. The perimeter of the planar top surface 46 is also an ellipse and, in this example, a circle of radius $r_t$ with a top center 50. The lateral surface 44 is defined as the locus of all straight line segments connecting the perimeter of the base surface 42 to the perimeter of the top surface 46 that, if extended, would pass through an imaginary apex 52. The frustum of a cone 40 has a rotational axis of symmetry 54 (hereinafter "axis 54") that passes through the imaginary apex 52, the base center 48 of the circular planar base surface 42, and the top center 50 of the circular planar top surface 46. In FIG. 2, the axis 54 is perpendicular or at a right angle to the planar base surface 42. Since the planar base surface 42 is circular and the axis 54 is disposed at a right angel to the base surface 42, the frustum of a cone 40 is characterized as a frustum of a right circular cone. The frustum of a cone has a height "h" that is the perpendicular distance between the planar base surface 42 and the planar top surface 46.

The embodiment of the method for manufacturing a radiator structure suitable for use with a helical antenna is described with respect to the manufacture of the radiator structure 22. Generally, the method involves: (a) providing a metal structure with a frusto-conical interior side surface and a frusto-conical exterior side surface that together form a frusto-conical wall that is modeled on the lateral or side surface of a frustum of a right circular cone and (b) removing metal from between the frusto-conical interior and exterior side surfaces to produce the helically shaped conductor 28.

Figure 3:
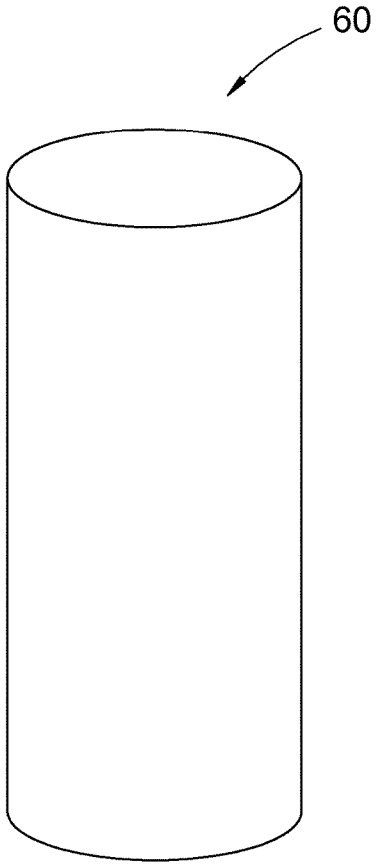
FIGS. 3-9 illustrate an embodiment of a method for making a radiator structure for a helical antenna that includes a conical helical conductor modeled on a right circular cone.

With reference to FIG. 3, the step of providing of a metal structure with a frusto-conical side wall is accomplished in several steps. Initially, a solid, round aluminum bar 60 (e.g., 6061-T6 or 6061-T651) is obtained. The dimensions of the bar 60 are sufficient to accommodate the radiator structure 22. It should be appreciated that other metal structures with different shapes and made of different materials can be utilized, provided the metal structure is of a shape that accommodates the dimensions of the radiator structure 22.

Figure 4:
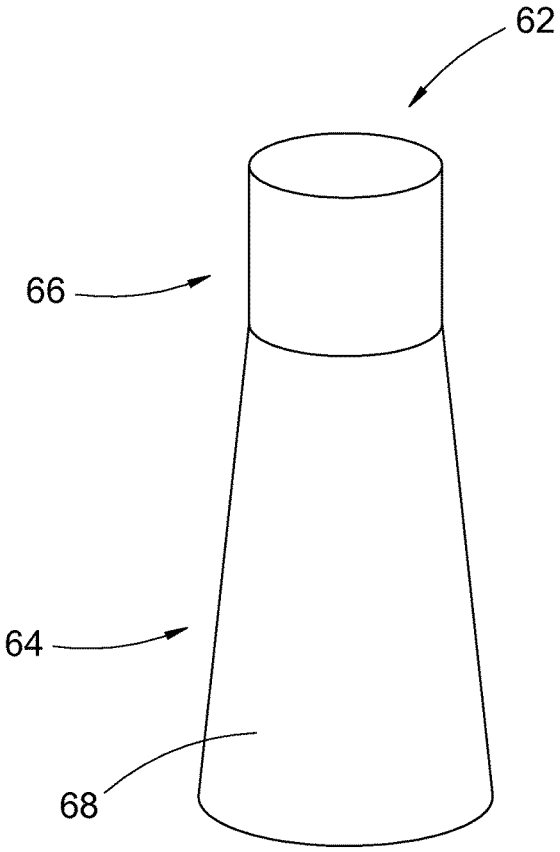

With reference to FIG. 4, the bar 60 is machined to produce a first metal structure 62 comprised of a solid frustum of a right circular cone 64 and a solid cylinder 66. This machining is accomplished with a lathe or other suitable metal machining or milling machine. The solid frustum of a cone 64 provides the material for realizing the helically shaped conductor 28, the matching structure 30, and a portion of the cap 32. Further, the solid frustum of a cone 64 defines a frusto-conical exterior side surface 68. The solid cylinder 64 provides material for realizing a portion of the cap 32. The solid cylinder 64 also provides a structure that can be engaged by a collet or chuck of a milling machine that is used in the subsequent removal of additional metal.

Figure 5:
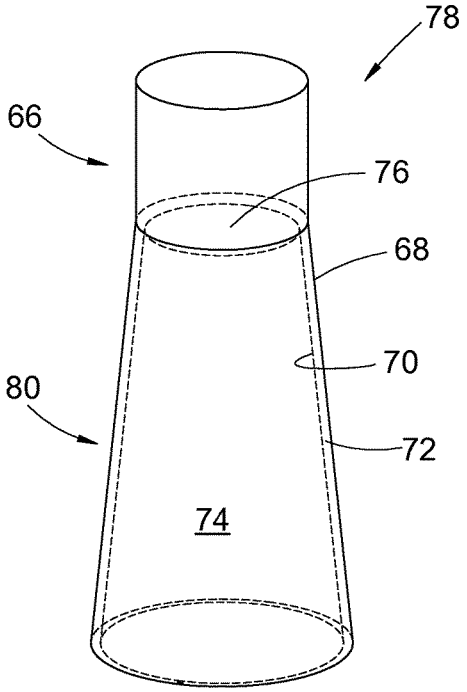

With reference to FIG. 5, the first metal structure 62 is machined to remove material associated with the solid frustum of a cone 64 and thereby realize a frusto-conical interior side surface 70. The frusto-conical exterior side surface 68 and the frusto-conical interior side surface 70 define a frusto-conical side wall 72 that encloses a space 74. The wall 72, in the illustrated embodiment, has a nominal wall thickness of 0.060" (0.152 cm). Additionally, the removal of the material to define the frusto-conical interior side surface 70 also defines a frusto-conical interior top surface 76. The machining is accomplished with a five-axis milling machine or other suitable milling machine with a collet or chuck that engages the solid cylinder 66. At this point, the bar 60 has been transformed into a second metal structure 78 comprised of a frusto-conical cup-like structure 80 and the solid cylinder 66. It is useful to conceptualize the second metal structure 78 at this point as having a radiator portion (i.e., the metal that will be the radiator structure 22) and a non-radiator portion (i.e., the metal that needs to be removed to realize the radiator structure 22). In this regard, a substantial portion of the frusto-conical cup-like structure 80 provides the material for realizing the helically shaped conductor 28, the matching structure 30, and a portion of the cap 32 and a portion of the solid cylinder 66 provides the material for realizing a portion of the cap 32. The frusto-conical cup-like structure 80 and the solid cylinder 28 also embody, at this point, the metal that needs to be removed to realize the radiator structure 22.

Figure 6:
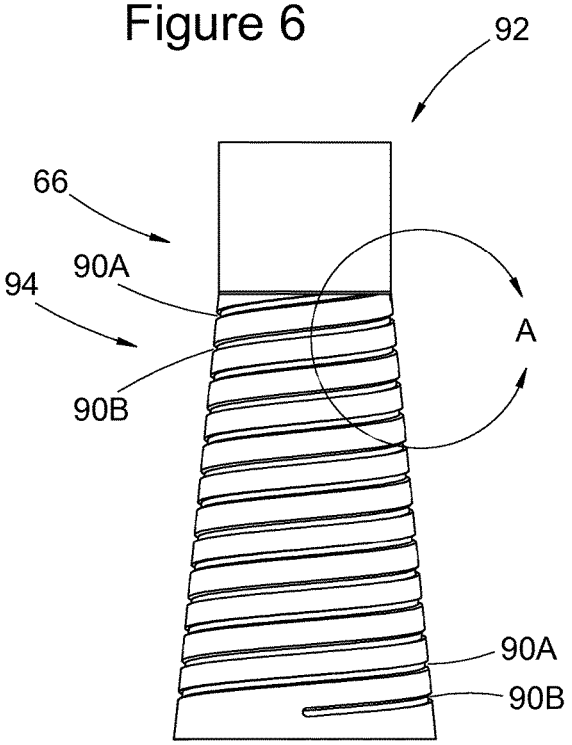
Figure 6:
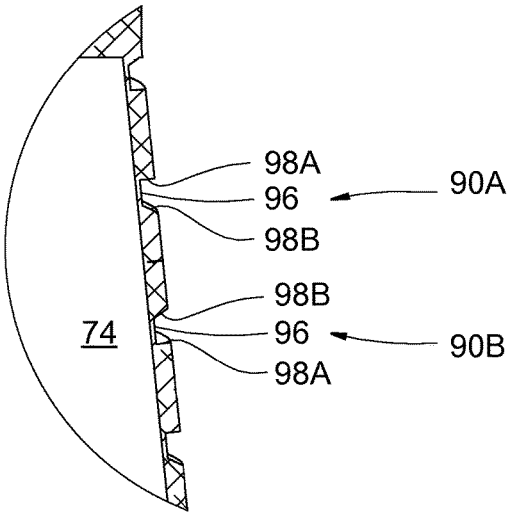

With reference to FIG. 6, the second metal structure 78 is machined to remove metal between the frusto-conical exterior side surface 68 and the frusto-conical interior side surface 70 to produce first and second helical grooves 90A, 90B in the frusto-conical cup-like structure 80. The first helical groove 90A partially defines a lower lateral edge 29A (see FIG. 1) of the helically shaped conductor 28. The second helical groove 90B partially defines the upper lateral edge 29B (see FIG. 1) of the helically shaped conductor 28. The helical grooves 90A, 90B only partially define the lateral edges 29A, 29B of the helically shaped conductor 28 because the grooves do not extend the entire way through the frusto-conical wall 72. The machining is accomplished with a five-axis milling machine or other suitable milling machine with a collet or chuck that engaged the solid cylinder 66. At this point, the bar 60 has been transformed into a third metal structure 92 comprised of a grooved, frusto-conical cup-like structure 94 and the solid cylinder 66. Each of the first and second helical grooves 90A, 90B has a groove base 96 that is located between first and second groove edges 98A, 98B. The first groove edge 98A of the first helical groove 90A partially defines the lower lateral edge 29A of the helically shaped conductor 28. The first groove edge 98A of the second helical groove 90B partially define the upper later edge 29B of the helically shaped conductor 28. In the illustrated embodiment, the distance between the groove base 96 of each of the first and second helical grooves 90A, 90B and the frusto-conical interior side surface 70 is 0.005" (0.013 cm). This thickness in combination with other properties of the aluminum has been found to provide sufficient integrity for additional machining of the third metal structure 92.

Figure 7:
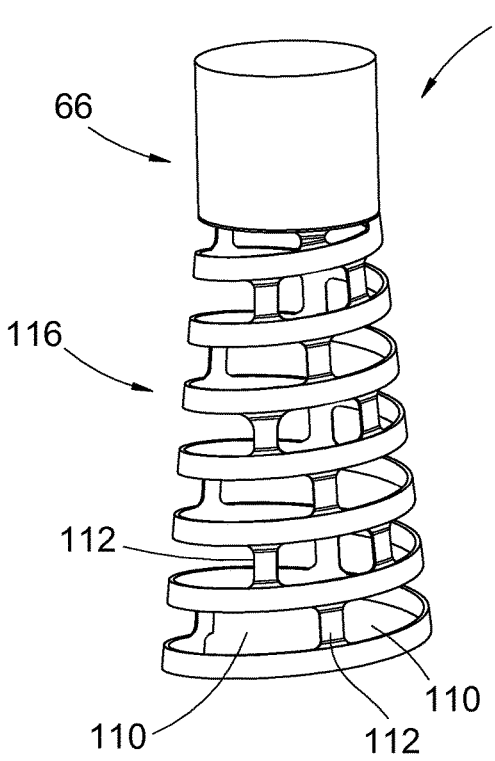

With reference to FIG. 7, the third metal structure 92 is machined to remove metal so as to form a series of intermittent helical voids 110 with consecutive helical voids separated from one another by helical struts 112, each of which has a width of approximately 0.06-0.09" (0.15-0.23 cm). In this regard, a single helical void is established by removing metal: (1) between the groove base 96 of the first helical groove 90A and the frusto-conical interior side surface 70 over an angular extent to establish a substantial angular portion of the lower lateral edge 29A, (2) between the groove base 96 of the second helical groove 90B and the frusto-conical interior side surface 70 over the angular extent to establish a substantial angular portion of the upper lateral edge 29B, (3) between first corresponding ends of the portions of lower and upper lateral edges established in the removals (1) and (2), and (4) between second corresponding ends of the portions of the lower and upper lateral edges established in the removals (1) and (2). These removals of metal are capable of being done in a number of different sequences. The machining is accomplished with a five-axis milling machine or other suitable milling machine with a collet or chuck that engaged the solid cylinder 66. At this point, the bar 60 has been transformed into a fourth metal structure 114 comprised of a frusto-conical cup-like structure that defines a series of intermittent helical voids 116 and the solid cylinder 66. Further, the graduated or multi-step removal of material between the frusto-conical exterior side surface 68 and the frusto-conical interior side surface 70 has facilitated the use of a milling machine to remove the metal. While more material could be potentially be removed with a milling machine, the likelihood of the removal of additional material being complicated due to vibrational issues and/or irreparable/unacceptable damage being imparted to the metal forming the helically shaped conductor substantially increases. The remaining metal between the frusto-conical exterior side surface 68 and the frusto-conical interior side surface 70 provides the material for realizing the helically shaped conductor 28, the matching structure 30 and a portion of the cap 32. The remaining metal between the frusto-conical exterior side surface 68 and the frusto-conical interior side surface 70 also defines, to a lesser extent, metal that still needs to be removed to realize the helically shaped conductor 28, the matching structure 30, and a portion of the cap 32.

Figure 8:
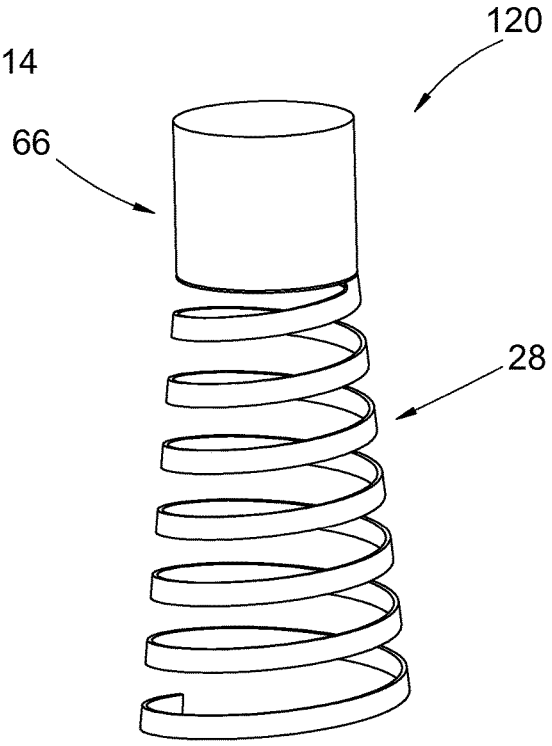

With reference to FIG. 8, the fourth metal structure 114 is processed to remove the struts 112. Due to the first and second helical grooves 90A, 90B extending across the width of each of the struts 112 and the relatively short width of each of the struts 112, removal of the struts can be readily accomplished with a hand tool, such as an X-Acto™ blade. Other hand tools can be employed in the removal of the struts 112, including powered hand tools that allow the user to exercise sufficient control to avoid the noted vibrational and/or damage issues. At this point, the bar 60 has been transformed into a fifth metal structure 120 comprised of the helically shaped conductor 28 and the solid cylinder 66.

It should be appreciated that the sequence of steps taken to transform the bar 60 into the fourth metal structure 114 can be altered. For example, the frusto-conical interior side surface 70 and the frusto-conical interior top surface 76 can be fabricated before the frusto-conical exterior side surface 68. Additionally, in certain cases, different steps may be used to achieve the fourth metal structure 114 or a similar structure with struts that can be readily removed in a manner that avoids the noted vibrational and/or damage issues. For example, the second metal structure 78 may be susceptible to being machined in a single step to achieve the metal structure 114 or a metal structure with intermittent helical voids that are separated from one another by helical struts that are susceptible to being removed in a manner that avoids the noted vibrational and/or damage issues.

Figure 9:
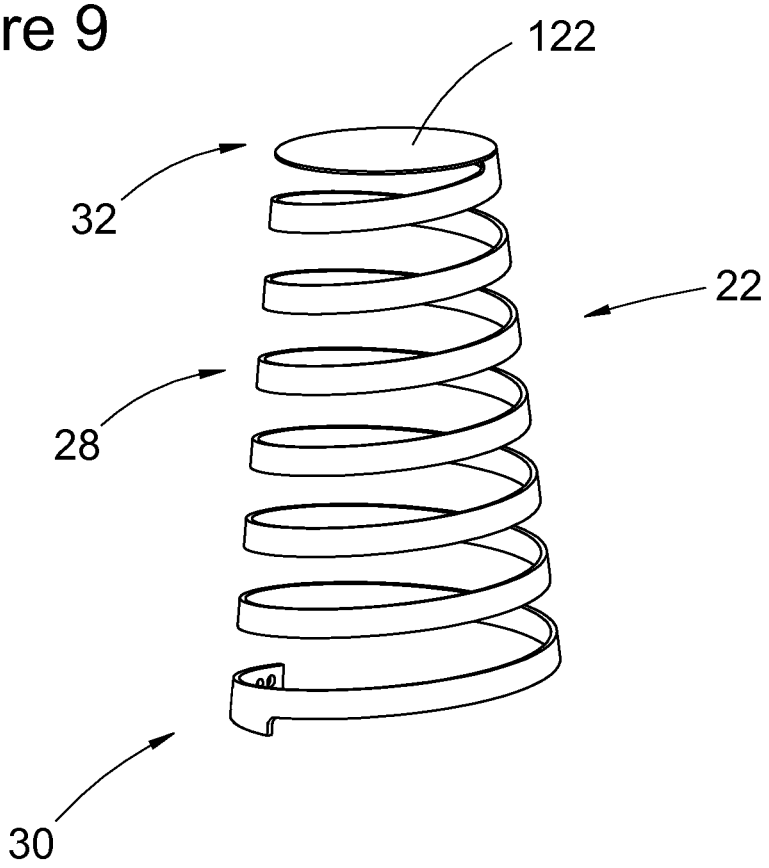

With reference to FIG. 9, the fifth metal structure 120 is processed so as to remove a substantial portion of, but not all of, the solid cylinder 66 to define a frusto-conical exterior top surface 122 that is substantially parallel to the frusto-conical interior top surface 76. The frusto-conical interior and exterior top surfaces 76, 122, in turn, substantially define the cap 32. It should be appreciate that the helically shaped conductor 28 and the cap 32 are a single piece of metal. As such, there is no need for a connecting structure extending between the helically shaped conductor 28 and the cap 32 that potentially could be a source of an undesirable passive intermode. It should be appreciated that the substantial portion of the solid cylinder 66 could be removed at any point in the method of manufacturing at which the solid cylinder 66 is no longer needed for engaging a collet or chuck of a milling machine or for any other purpose. For example, the substantial portion of the solid cylinder 66 could be removed before the struts 112 are removed. Further, while the cap 32 has a circular shape, the cap need not have such a shape to be effective in preventing an undesirable reflection that could adversely affect the polarization of the signals being processed by the helical antenna. The cap 32 need only be of sufficient shape and extent to substantially inhibit this undesired reflection. Consequently, if in removing a substantial portion of the solid cylinder 66 a non-circular cap with a substantially smaller extent than the last turn of the helically shaped conductor 28 is produced, the cap may nonetheless be sufficient for preventing the undesired reflection. Additionally, if a particular radiator structure does not require a cap or it is desirable to have a separate cap with a connective structure that extends between the cap and the helically shaped conductor, the entire solid cylinder 66 and any metal extending from the frusto-conical interior top surface 76 to the solid cylinder 66 can be removed.

Figure 10:
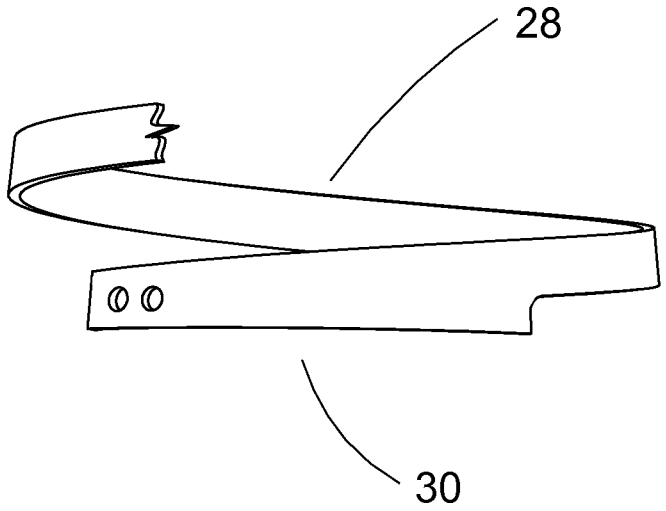
FIG. 10 illustrates a matching structure that is part of the radiator structure produced using the method illustrated in FIGS. 3-9.

With reference to FIG. 10, the radiator structure 22 illustrated in FIG. 9 includes the matching structure 30 that provides the antenna 20 with a desired or acceptable VSWR. The matching structure 30 is established or the material for the later establishment of the matching structure 30 is present in the third metal structure 92. Regardless of whether the matching structure 30 is established in the third metal structure 92 or created from metal present in the third metal structure 92 at a later time, the matching structure 30 and the helically shaped conductor 28 are a single piece of metal. As such, there is no need for a connecting structure extending between the helically shaped conductor 28 and the matching structure 30 that potentially could be a source of an undesirable passive intermode. It should be appreciated that in some helical antennas a matching structure may not be needed. For such helical antennas, the manufacturing method can be modified to forego the making of the matching structure 30.

It should be appreciated that the method is also adaptable to the manufacture of a radiator structures that are modeled on an oblique circular cone, a right elliptical cone, an oblique elliptical cone, and a cylinder. In this regard and with reference to FIG. 18, the manufacture of a radiator structure 200 modeled on an oblique elliptical cone is also described. The radiator structure 200 comprises a helically shaped conductor 202, a matching structure 204 associated one end of the conductor 28, and a cap 206 associated with the other end of the conductor 28. The helically shaped conductor 202 is the portion of the radiator structure 200 that is primarily responsible for the transmission and/or reception of electromagnetic signals by an antenna that utilizes the radiator structure 200. The matching structure 204 provides an antenna that incorporates the radiator structure 200 with a desired or acceptable VSWR. The cap 206 prevents the reflection of a signal being processed by an antenna that employs the radiator structure 200 from adversely affecting the polarization of the signal.

Figure 11:
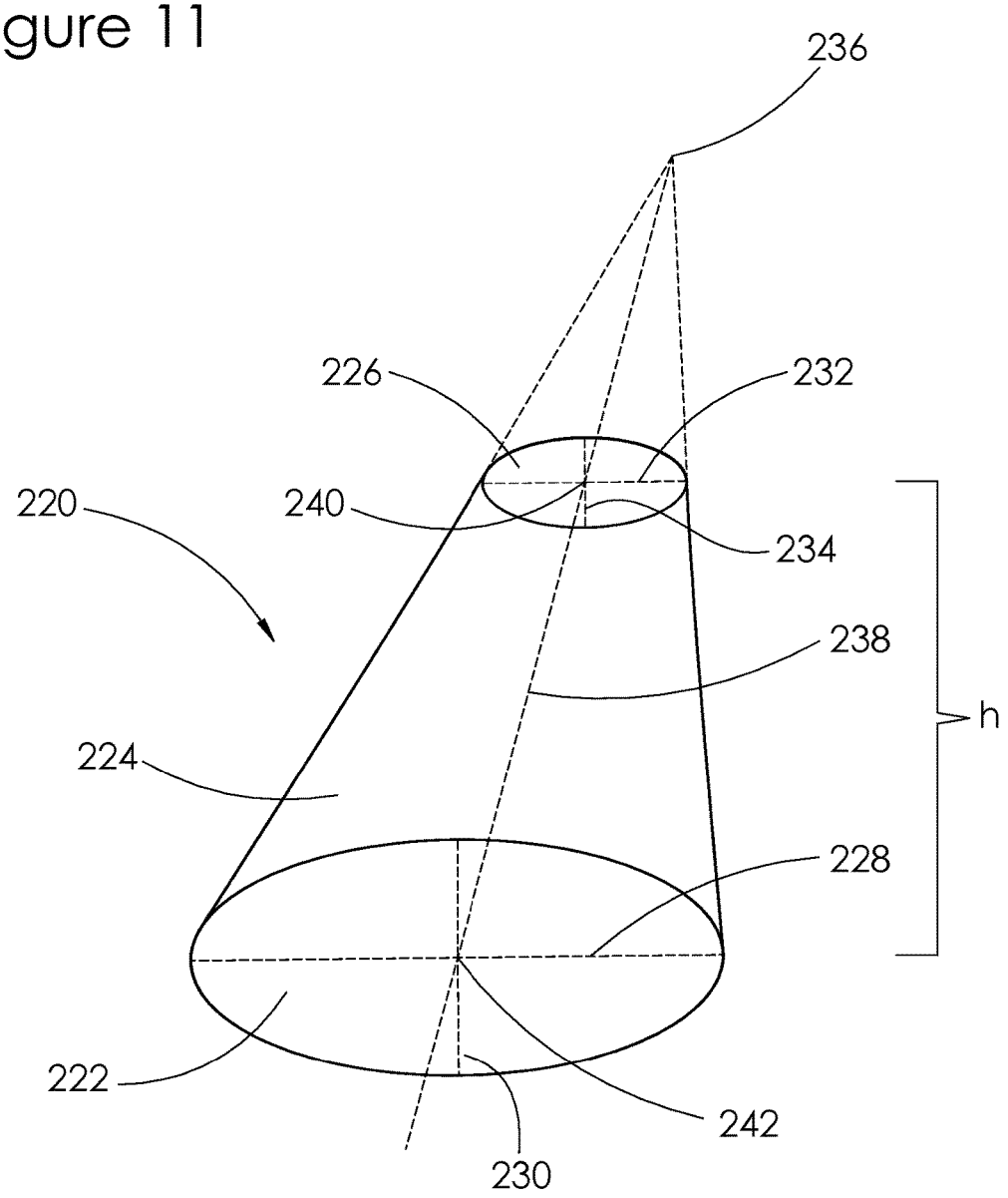
FIG. 11 illustrates an oblique elliptical cone and a frustum of an oblique elliptical cone.

The helically shaped conductor 202 is modeled on a frustum of an oblique elliptical cone. With reference to FIG. 11, a frustum of an oblique elliptical cone 220 is illustrated. The frustum of an oblique elliptical cone 220 is defined by a planar base surface 222, a lateral or side surface 224, and a planar top surface 226 that is parallel to the planar base surface 42. The perimeter of the planar base surface 222 is an ellipse with an eccentricity that is greater than zero (i.e., not a circle). The perimeter of the planar top surface 46 is also an ellipse with an eccentricity that is greater than zero. The elliptical shape associated with the planar base surface 222 has a major axis 228 and a minor axis 230. The elliptical shape associated with the planar top surface 226 has a major axis 232 and a minor axis 234. The major axes 228, 232 of the elliptical shapes of the planar base and top surfaces 222, 226 are substantially parallel to one another. Further, the minor axes 230, 234 of the elliptical shapes associated with the planar base and top surfaces 222, 226 are substantially parallel to one another. The lateral surface 224 is defined as the locus of all straight line segments connecting the perimeter of the base surface 222 to the perimeter of the top surface 226 that, if extended, would pass through an imaginary apex 236. A line 238 can be defined that passes through the imaginary apex 236, a first intersection point 240 of the major axis 232 and the minor axis 234 of the planar top surface 226, and a second intersection point 242 of the major axis 228 and minor axis 230 of the planar base surface 222. The line 238 is not perpendicular to the elliptically shaped planar base surface 222. Since the line 238 is not at a right angle to the planar base surface 222 and the planar base surface has an elliptical shape, the frustum of a cone 220 is characterized as a frustum of an oblique elliptical cone. The frustum of an oblique elliptical cone 220 has a height "h" that is the perpendicular distance between the planar base surface 222 and the planar top surface 226.

The embodiment of the method for manufacturing a radiator structure suitable for use with a helical antenna is described with respect to the manufacture the radiator structure 200. Generally, the method involves: (a) providing a metal structure with a frusto-conical interior side surface and a frusto-conical exterior side surface that together form a frusto-conical wall that is modeled on the lateral or side surface of a frustum of a right circular cone and (b) removing metal from between the frusto-conical interior and exterior side surfaces to produce the helically shaped conductor 200.

As with the method described in connection with FIGS. 3-10, the step of providing of a metal structure with a frusto-conical side wall is accomplished in several steps. In this regard, the steps of obtaining a round aluminum bar or other electrically conductive stock of sufficient dimensions to accommodate the radiator structure and machining the bar to produce the first metal structure 62 comprised of the solid frustum of a right circular cone 64 and the solid cylinder 66 are the same as described with respect to the method of producing the helically shaped conductor 28 that is modeled on a frustum of a right circular cone. This machining is accomplished with a lathe or other suitable metal machining or milling machine. The solid frustum of a right circular cone 64 provides the material for realizing the helically shaped conductor 202 that is modeled on an oblique elliptical cone, the matching structure 204, and the cap 206. Further, the solid frustum of a right circular cone 64 defines a frusto-conical exterior side surface 68. The solid cylinder 64 provides a structure that can be engaged by a collet or chuck of a milling machine that is used in the subsequent removal of additional metal.

Figure 12:
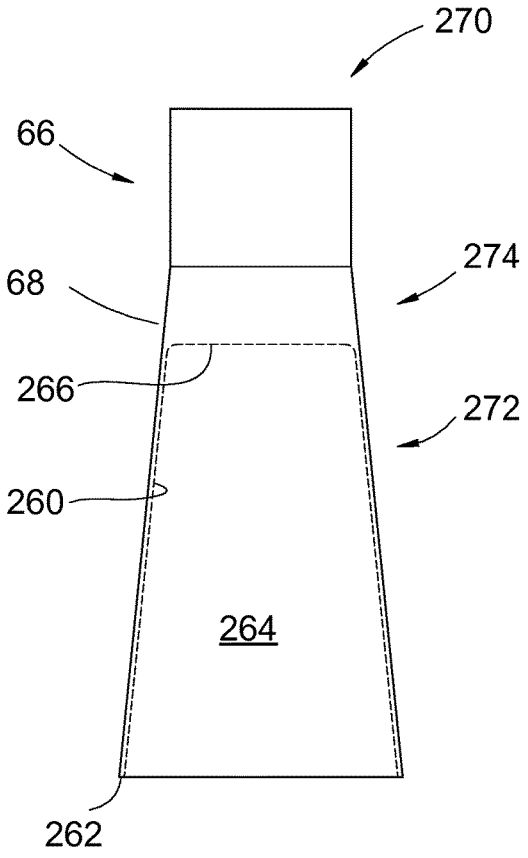
FIGS. 12-18 illustrate an embodiment of a method for making a radiator structure for a helical antenna that includes a conical helical conductor modeled on an oblique elliptical cone.

With reference to FIG. 12, the first metal structure 62 is machined to remove material associated with the solid frustum of a cone 64 and thereby realize a frusto-conical interior side surface 260. The frusto-conical exterior side surface 68 and the frusto-conical interior side surface 260 define a frusto-conical side wall 262 that encloses a space 264. The wall 262, in the illustrated embodiment, has a nominal wall thickness of 0.060" (0.152 cm). Additionally, the removal of the material to define the frusto-conical interior side surface 260 also defines a first frusto-conical interior top surface 266 (i.e., a top surface of a right circular cone). The machining is accomplished with a five-axis milling machine or other suitable milling machine with a collet or chuck that engages the solid cylinder 66. At this point, the bar 60 has been transformed into a second metal structure 270 comprised of the solid cylinder 66, a first frusto-conical cup-like structure 272, and a solid frustum of a right circular cone 274 that extends between the cup-like structure and the cylinder. The frusto-conical cup-like structure 272 provides material for realizing the helically shaped conductor 202 and the matching structure 204. The solid frustum of a right circular cone 274 provides material for producing the helically the helically shaped conductor 202 and the cap 206.

Figure 13:
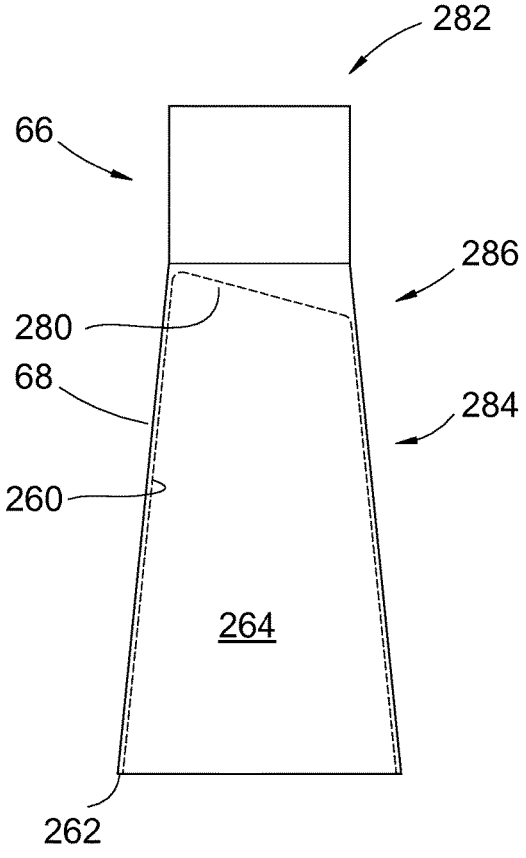

With reference to FIG. 13, the second metal structure 270 is machined to produce a second frusto-conical interior top surface 280 (i.e., a top surface of an oblique elliptical cone) that supersedes the first frusto-conical interior top surface 266. In addition the machining extends the frusto-conical interior side surface 260. It should be appreciated that the second frusto-conical interior top surface 280 is elliptical. The machining is accomplished with a five-axis milling machine or other suitable milling machine with a collet or chuck that engages the solid cylinder 66. At this point, the bar 60 has been transformed into a third metal structure 282 comprised of the solid cylinder 66, a partly frusto-conical cup-like structure 284, and a solid section of a frustum of a right circular cone 286 that extends between the cup-like structure and the cylinder. A substantial portion of the partly frusto-conical cup-like structure 284 provides material for realizing the helically shaped conductor 202, the matching structure 204, and a portion of the cap 206. The solid section of a frustum of a right circular cone 286 provides material for producing a portion of the cap 206.

Figure 14:
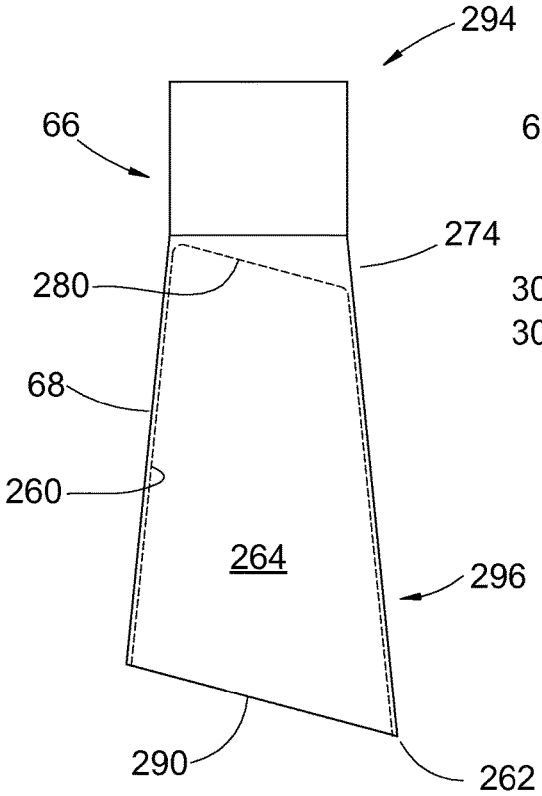

With reference to FIG. 14, the metal structure 280 is machined to remove a portion of the frusto-conical side wall 262 to define a new base edge 290 for the frusto-conical side wall 262. The machining is accomplished with a five-axis milling machine or other suitable milling machine with a collet or chuck that engages the solid cylinder 66. The new base edge 290 lies in a plane that is substantially parallel to the frusto-conical interior top surface 280. Further, the new base edge 290 has an elliptical shape that has major and minor axes that are substantially parallel to the major and minor axes of the elliptical shape associated with the frusto-conical interior top surface 280. At this point, the bar 60 has been transformed into a fourth metal structure 294 comprised of the cylinder 66, a frusto-conical cup-like structure 296 that is modeled on an oblique elliptical cone, and the solid section of a frustum of a right circular cone 286. It is useful to conceptualize the second metal structure 294 at this point as having a radiator portion (i.e., the metal that will be the radiator structure 200) and a non-radiator portion (i.e., the metal that needs to be removed to realize the radiator structure 200). In this regard, a substantial portion of the frusto-conical cup-like structure 296 provides material for realizing the helically shaped conductor 202, the matching structure 204, and a portion of the cap 206 and a portion of the solid section of a frustum of a right circular cone 286 provides material for producing a portion of the cap 206. The frusto-conical cup-like structure 296, the solid section of a frustum of a right circular cone 286, and the solid cylinder 66 also embodies the metal that needs to be removed to realize the radiator 200.

Figure 15:
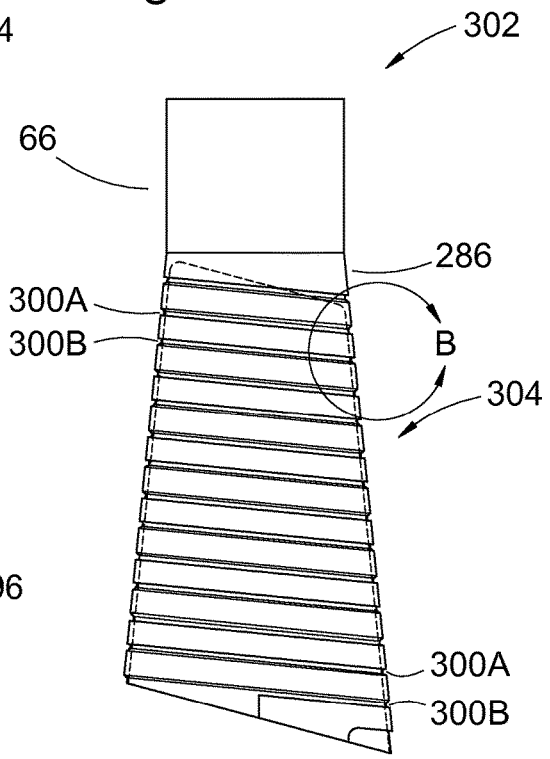
Figure 15:
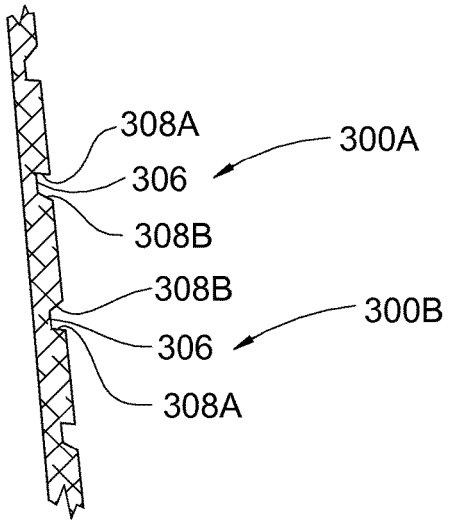

With reference to FIG. 15, the metal structure 294 is machined is to remove metal between the frusto-conical exterior side surface 68 and the frusto-conical interior side surface 260 to produce first and second helical grooves 300A, 300B in the frusto-conical cup-like structure 296. The first helical groove 300A partially defines a lower lateral edge 203A (see FIG. 18) of the helically shaped conductor 202. The second helical groove 300B partially defines the upper lateral edge 203B (see FIG. 18) of the helically shaped conductor 202. The helical grooves 300A, 300B only partially define the lateral edges 203A, 203B of the helically shaped conductor 202 because the grooves do not extend the entire way through the frusto-conical wall 262. The machining is accomplished with a five-axis milling machine or other suitable milling machine with a collet or chuck that engaged the solid cylinder 66. At this point, the bar 60 has been transformed into a fifth metal structure 302 comprised of the cylinder 66, a grooved, frusto-conical cup-like structure 304, and the solid section of a frustum of a right circular cone 286. Each of the first and second helical grooves 300A, 300B has a groove base 306 that is located between first and second groove edges 308A, 308B. The first groove edge 308A of the first helical groove 300A partially defines the lower lateral edge 203A of the helically shaped conductor 202. The first groove edge 308A of the second helical groove 300B partially define the upper later edge 203B of the helically shaped conductor 202. In the illustrated embodiment, the distance between the groove base 306 of each of the first and second helical grooves 300A, 300B and the frusto-conical interior side surface 260 is 0.005" (0.013 cm). This thickness in combination with other properties of the aluminum has been found to provide sufficient integrity for additional machining of the metal structure 302.

Figure 16:
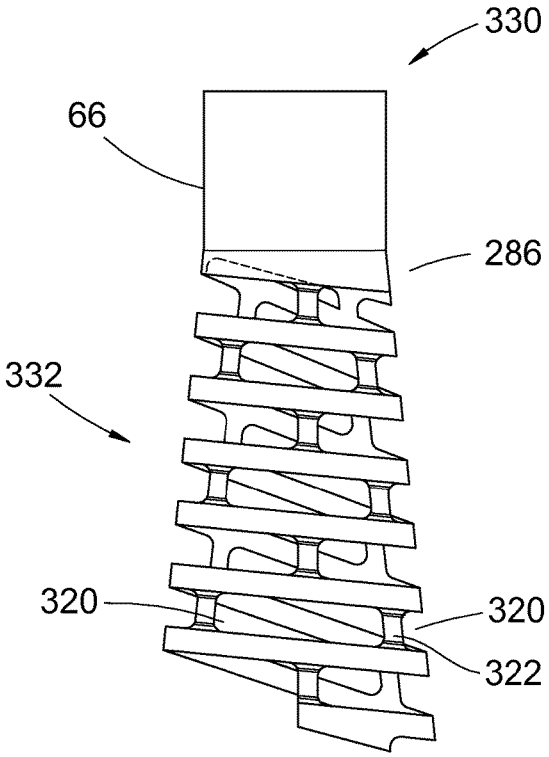

With reference to FIG. 16, the fifth metal structure 302 is machined to remove metal so as to form a series of intermittent helical voids 320 with consecutive helical voids separated from one another by helical struts 322, each of which has a width of approximately 0.06-0.09" (0.15-0.23 cm). In this regard, a single helical void is established by removing metal: (1) between the groove base 306 of the first helical groove 300A and the frusto-conical interior side surface 260 over an angular extent to establish a substantial angular portion of the lower lateral edge 203A, (2) between the groove base 306 of the second helical groove 300B and the frusto-conical interior side surface 260 over the angular extent to establish a substantial angular portion of the upper lateral edge 203B, (3) between first corresponding ends of the portions of lower and upper lateral edges established in the removals (1) and (2), and (4) between second corresponding ends of the portions of the lower and upper lateral edges established in the removals (1) and (2). These removals of metal are capable of being done in a number of different sequences. The machining is accomplished with a five-axis milling machine or other suitable milling machine with a collet or chuck that engaged the solid cylinder 66. At this point, the bar 60 has been transformed into a sixth metal structure 330 comprised of the solid cylinder 66, a frusto-conical cup-like structure that defines a series of intermittent helical voids 332, and the solid section of a frustum of a right circular cone 286. Further, the graduated or multi-step removal of material between the frusto-conical exterior side surface 68 and the frusto-conical interior side surface 260 has facilitated the use of a milling machine to remove the metal. While more material could be potentially be removed with a milling machine, the likelihood of the removal of additional material being complicated due to vibrational issues or irreparable/unacceptable damage being imparted to the metal forming the helically shaped conductor substantially increases. The remaining metal between the frusto-conical exterior side surface 68 and the frusto-conical interior side surface 260 provides the material for realizing the helically shaped conductor 202 and the matching structure 204. The solid section of a frustum of a right circular cone 286 provides material for producing the cap 206. The remaining metal between the frusto-conical exterior side surface 68 and the frusto-conical interior side surface 260 also defines, to a lesser extent, metal that still needs to be removed to realize the helically shaped conductor 28 and the matching structure 30.

Figure 17:
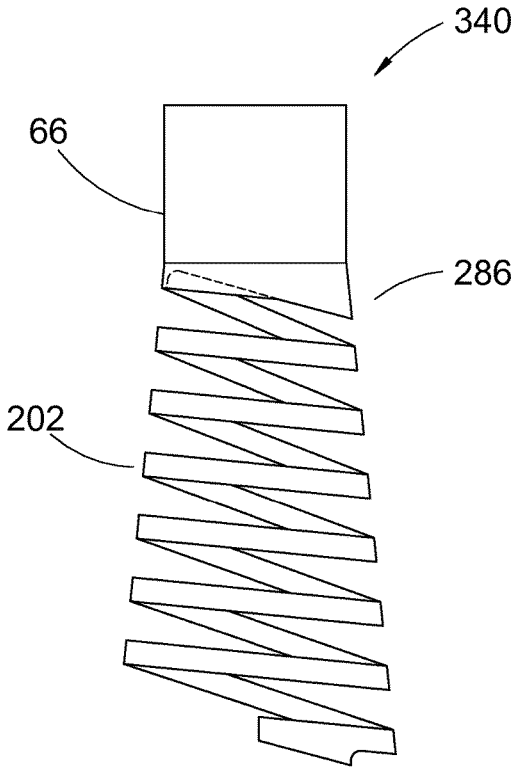

With reference to FIG. 17, the metal structure 330 is processed to remove the struts 322. Due to the first and second helical grooves 300A, 300B extending across the width of each of the struts 322 and the relatively short width of each of the struts 322, removal of the struts can be readily accomplished with a hand tool, such as an X-Acto™ blade. Other hand tools can be employed in the removal of the struts 322, including powered hand tools that allow the user to exercise sufficient control to avoid the noted vibrational and/or damage issues. At this point, the bar 60 has been transformed into a metal structure 340 comprised of the solid cylinder 66, the helically shaped conductor 202, and the solid section of a frustum of a right circular cone 286.

It should be appreciated that the sequence of steps taken to transform the bar 60 into the sixth metal structure 330 can be altered. For example, the first metal structure 62 could be processed to realize a solid with a planar elliptical base surface that, when a frusto-conical interior side surface is later created, provides the material that defines the base edge 290. Additionally, in certain cases, different steps may be used to achieve the sixth metal structure 330 or a similar structure with struts that can be readily removed in a manner that avoids the noted vibrational and/or damage issues. For example, the fourth metal structure 294 may be susceptible to being machined in a single step to achieve the metal structure 330 or a metal structure with intermittent helical voids that are separated from one another by helical struts that are susceptible to being removed in a manner that avoids the noted vibrational and/or damage issues.

Figure 18:
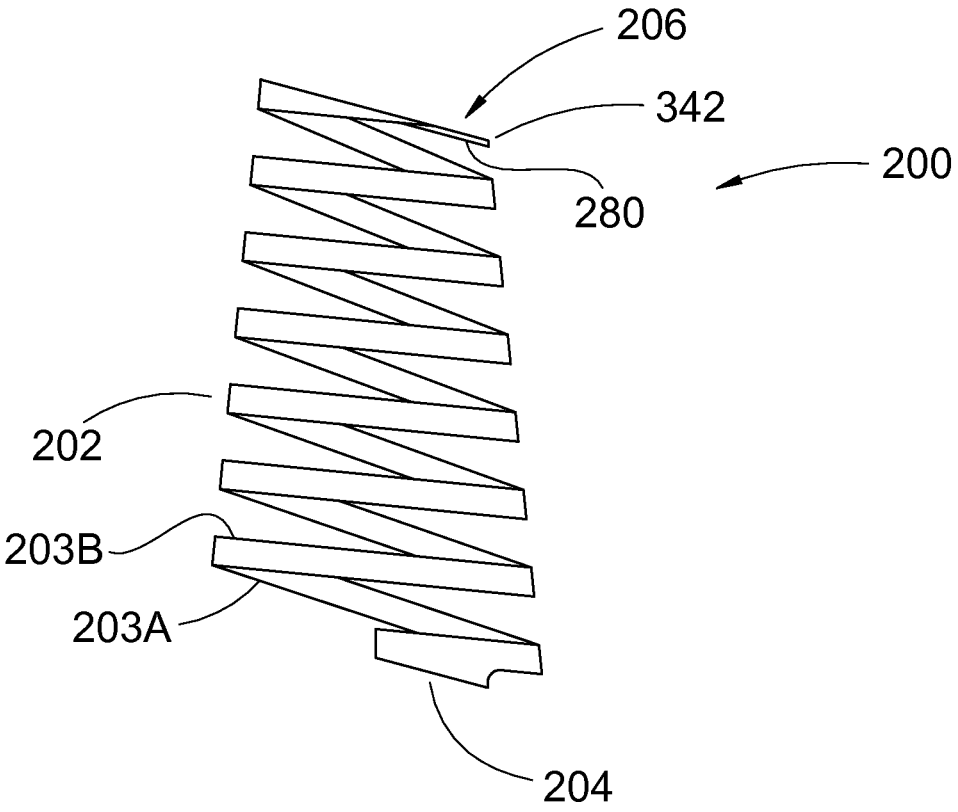

With reference to FIG. 18, the metal structure 340 is processed so as to remove a substantial portion of, but not all of, the solid cylinder 66 and the solid section of a frustum of a right circular cone 286 to define a frusto-conical exterior top surface 342 that is substantially parallel to the frusto-conical interior top surface 280. The frusto-conical interior and exterior top surfaces 280, 342, in turn, substantially define the cap 206. It should be appreciated that the helically shaped conductor 202 and the cap 206 are a single piece of metal. As such, there is no need for a connecting structure extending between the helically shaped conductor 202 and the cap 206 that potentially could be a source of an undesirable passive intermode. It should be appreciated that the substantial portion of the solid cylinder 66 and the solid section of a frustum of a right circular cone 286 could be removed at any point in the method of manufacturing at which the solid cylinder 66 is no longer needed for engaging a collet or chuck of a milling machine or for any other purpose. For example, the substantial portion of the solid cylinder 66 and the solid section of a frustum of a right circular cone 286 could be removed before the struts 322 are removed. Further, while the cap 206 has an elliptical shape, the cap need not have such a shape to be effective in preventing an undesirable reflection that could adversely affect the polarization signals being processed by the antenna. The cap 206 need only be of sufficient shape and extent to substantially inhibit this undesired reflection. Consequently, if in removing a substantial portion of the solid cylinder 66 and the solid section of a frustum of a right circular cone 286 a non-elliptical cap with a substantially smaller extent than the last turn of the helically shaped conductor 202 is produced, the cap may nonetheless be sufficient for preventing the undesired reflection. Additionally, if a particular radiator structure does not require a cap or it is desirable to have a separate cap with a connective structure that extends between the cap and the helically shaped conductor, the entire solid cylinder 66 and any metal extending from the frusto-conical interior top surface 280 to the solid cylinder 66 can be removed.

With reference to FIG. 15, the radiator structure 200 illustrated in FIG. 18 includes the matching structure 204 that provides the helical antenna that incorporates the radiator structure 200 with a desired or acceptable VSWR. The matching structure 204 is established or the material for the later establishment of the matching structure 204 is present in the fifth metal structure 302. As such, the subsequently created helically shaped conductor 202 and the matching structure 204 are a single piece of metal. As such, there is no need for a connecting structure extending between the helically shaped conductor 200 and the matching structure 204 that potentially could be the source of an undesirable passive intermode. It should be appreciated that in some helical antennas a matching structure may not be needed. For such helical antennas, the manufacturing method can be modified to forego the making of the matching structure 204.

While the helically shaped conductors 28, 202 respectively associated with the radiator structures 22 and 202 resulting from the manufacturing process described herein both have a "right-handed twist", the manufacture process can be readily adapted to the production of helically shaped conductors that have a "left-handed twist".

The foregoing description of the invention is intended to explain the best mode known of practicing the invention and to enable others skilled in the art to utilize the invention in various embodiments and with the various modifications required by their particular applications or uses of the invention.

What is claimed is:

1. A method for making a radiator structure for a helical antenna, comprising:

providing a piece of metal stock;

processing the piece of metal stock to produce a processed piece of metal with a frusto-conical exterior side surface and a frusto-conical interior side surface with the frusto-conical exterior and interior side surfaces defining a frusto-conical side wall, the processed piece of metal having a radiator portion and a non-radiator portion; and removing metal located between the frusto-conical exterior side surface and the frusto-conical interior side surface and associated with the non-radiator portion to produce a self-supporting conical helix having an upper lateral edge and a lower lateral edge that is separated from the upper lateral edge;

the step of removing includes first removing metal located between the frusto-conical interior side surface and the frusto-conical exterior side surface and associated with the non-radiator portion to define a portion of the upper lateral edge of the conical helix and a portion of the lower lateral edge of the conical helix;

the portion of the upper lateral edge of the conical helix extending partially from one of the frusto-conical exterior side surface and the frusto-conical interior side surface to the other of the frusto-conical exterior side surface and the frusto-conical interior side surface;

the portion of the lower lateral edge of the conical helix extending partially from one of the frusto-conical exterior side surface and the frusto-conical interior side surface to the other of the frusto-conical exterior side surface and the frusto-conical interior side surface; and the step of removing includes, following the step of first removing, second removing metal associated with the non-radiator portion to define a series of helical voids with one helical void separated from an immediately adjacent helical void by a helical strut that is associated with the non-radiator portion.

2. A method, as claimed in claim 1, wherein:

the step of second removing includes removing metal extending from a groove base surface to one of the frusto-conical interior side surface and the frusto-conical exterior side surface.

3. A method, as claimed in claim 1, wherein:

the step of second removing includes removing metal extending from the frusto-conical interior side surface to the frusto-conical exterior side surface.

4. A method, as claimed in claim 1, wherein:

the step of removing includes, following the step of second removing, third removing each helical strut associated with the non-radiator portion.

5. A method, as claimed in claim 1, wherein:

the frusto-conical side wall is a side wall of one of: (a) a frustum of a right circular cone, (b) a frustum of an oblique circular cone, (c) a frustum of a right elliptical cone, and (d) a frustum of an oblique elliptical cone.

6. A method, as claimed in claim 1, further comprising:

removing metal from the frusto-conical exterior side surface to the frusto-conical interior side surface and associated with the non-radiator portion to produce an impedance matching structure.

7. A method, as claimed in claim 6, wherein:

the conical helix and the matching structure are a single piece of metal.

8. A method for making a radiator structure for a helical antenna, comprising:

providing a piece of metal stock;

processing the piece of metal stock to produce a processed piece of metal with a frusto-conical exterior side surface and a frusto-conical interior side surface with the frusto-conical exterior and interior side surfaces defining a frusto-conical side wall, the processed piece of metal having a radiator portion and a non-radiator portion; and removing metal located between the frusto-conical exterior side surface and the frusto-conical interior side surface and associated with the non-radiator portion to produce a self-supporting conical helix having an upper lateral edge and a lower lateral edge that is separated from the upper lateral edge;

the step of removing includes first removing metal located between the frusto-conical interior side surface and the frusto-conical exterior side surface and associated with the non-radiator portion to define a portion of the upper lateral edge of the conical helix and a portion of the lower lateral edge of the conical helix;

the portion of the upper lateral edge of the conical helix extending partially from one of the frusto-conical exterior side surface and the frusto-conical interior side surface to the other of the frusto-conical exterior side surface and the frusto-conical interior side surface;

the portion of the lower lateral edge of the conical helix extending partially from one of the frusto-conical exterior side surface and the frusto-conical interior side surface to the other of the frusto-conical exterior side surface and the frusto-conical interior side surface; and the step of first removing metal establishes a first helical groove in the frusto-conical side wall and a second helical groove in the frusto-conical side wall that is separated from the first helical groove;

wherein the first and second helical grooves each have a first groove side surface, a second groove side surface, and a groove base surface located between the first and second groove side surfaces;

the step of removing includes, following the step of first removing, second removing metal associated with the non-radiator portion to define a series of helical voids with one helical void separated from an immediately adjacent helical void by a helical strut that is associated with the non-radiator portion.

9. A method, as claimed in claim 8, wherein:

the step of second removing includes removing metal extending from the groove base surface of each of the first and second grooves to one of the frusto-conical interior side surface and the frusto-conical exterior side surface.

10. A method, as claimed in claim 8, wherein:

the step of second removing includes removing metal extending from the frusto-conical interior side surface to the frusto-conical exterior side surface.

11. A method, as claimed in claim 8, wherein:

the step of removing includes, following the step of second removing, third removing each helical strut associated with the non-radiator portion.

12. A method for making a radiator structure for a helical antenna, comprising:

providing a piece of metal having a frusto-conical interior side surface and a frusto-conical exterior side surface, the frusto-conical interior and exterior side surfaces defining a frusto-conical side wall, the piece of metal having a radiator portion and a non-radiator portion; and removing material between the frusto-conical exterior side surface and the frusto-conical interior side surface and associated with the non-radiator portion to produce a self-supporting conical helix having an upper lateral edge and a lower lateral edge that is separated from the upper lateral edge;

the step of removing includes first removing metal located between the frusto-conical interior side surface and the frusto-conical exterior side surface and associated with the non-radiator portion to define a portion of the upper lateral edge of the conical helix and a portion of the lower lateral edge of the conical helix;

the portion of the upper lateral edge of the conical helix extending partially from one of the frusto-conical exterior side surface and the frusto-conical interior side surface to the other of the frusto-conical exterior side surface and the frusto-conical interior side surface;

the portion of the lower lateral edge of the conical helix extending partially from one of the frusto-conical exterior side surface and the frusto-conical interior side surface to the other of the frusto-conical exterior side surface and the frusto-conical interior side surface;

the step of removing includes, following the step of first removing, second removing metal associated with the non-radiator portion to define a series of helical voids with one helical void separated from an immediately adjacent helical void by a helical strut that is associated with the non-radiator portion.

13. A method, as claimed in claim 12, wherein:

the step of removing includes, following the step of second removing, third removing a helical strut associated with the non-radiator portion.

14. A method for making a radiator structure for a helical antenna, comprising:

providing a piece of metal having a frusto-conical interior side surface and a frusto-conical exterior side surface, the frusto-conical interior and exterior side surfaces defining a frusto-conical side wall, the piece of metal having a radiator portion and a non-radiator portion; and removing material between the frusto-conical exterior side surface and the frusto-conical interior side surface and associated with the non-radiator portion to produce, in the radiator portion, a self-supporting conical helix having an upper lateral edge and a lower lateral edge that is separated from the upper lateral edge;

the step of removing includes removing metal associated with the non-radiator portion to define, in the non-radiator portion, a series of helical voids with one helical void separated from an immediately adjacent helical void by a helical strut that is associated with the non-radiator portion.

15. A method, as claimed in claim 14, wherein:

the step of removing includes removing a helical strut associated with the non-radiator portion.

16. A method, as claimed in claim 14, wherein:

the step of providing includes providing a frusto-conical interior top surface that engages the frusto-conical interior side surface.

17. A method, as claimed in claim 16, wherein:

the step of providing includes providing a stub extending away from the frusto-conical interior top surface.

18. A method for making a radiator structure for a helical antenna, comprising:

providing a piece of metal having a frusto-conical interior side surface and a frusto-conical exterior side surface, the frusto-conical interior and exterior side surfaces defining a frusto-conical side wall, the piece of metal having a radiator portion and a non-radiator portion; and removing material between the frusto-conical exterior side surface and the frusto-conical interior side surface and associated with the non-radiator portion to produce a self-supporting conical helix having an upper lateral edge and a lower lateral edge that is separated from the upper lateral edge;

the step of providing includes providing a frusto-conical interior top surface that engages the frusto-conical interior side surface;

the step of providing includes providing a stub extending away from the frusto-conical interior top surface;

removing a portion of the stub to produce a frusto-conical exterior top surface;

the frusto-conical interior and exterior top surfaces defining a frusto-conical top.

19. A method, as claimed in claim 18, wherein:

the conical helix and the frusto-conical top are a single piece of metal.

20. A method for making a radiator structure for a helical antenna, comprising:

providing a monolithic metal structure having a frusto-conical interior side surface and a frusto-conical exterior side surface that define a frusto-conical side wall that encloses a space and defines intermittent helical voids, the monolithic metal structure having a radiator portion and a non-radiator portion, the intermittent helical voids defining a helical void path that is associated with the non-radiator portion, the intermittent helical voids also defining a portion of an upper lateral edge and a portion of a lower lateral edge of a conical helix that is associated with the radiator portion, the helical void path is located between first and second portions of the conical helix associated with the radiator portion;

the intermittent helical voids comprising a first helical void and a second helical void separated from the first helical void by a helical strut that extends from the first portion of the conical helix to the second portion of the conical helix and is associated with the non-radiator portion; and removing metal associated with the helical strut to produce the conical helix.

21. A method, as claimed in claim 20, wherein:

the step of providing comprises processing a piece of metal to produce the frusto-conical exterior side surface.

22. A method, as claimed in claim 20, wherein:

the step of providing comprises processing a piece of metal to produce the frusto-conical interior side surface.

23. A method, as claimed in claim 20, wherein:

the step of providing comprises processing a piece of metal to define the intermittent helical voids.

24. A method, as claimed in claim 20, wherein:

the conical helix is a self-supporting conical helix.

25. A method, as claimed in claim 20, wherein:

the step of removing includes cutting metal associated with or adjacent to the helical strut.

* * * * *